United States Patent [19]

Streicher

[11] Patent Number: 5,049,048

[45] Date of Patent: Sep. 17, 1991

[54] HOSE PUMP

[75] Inventor: Manfred Streicher, Beilstein, Fed. Rep. of Germany

[73] Assignee: KWW Gesellschaft für Verfahrenstechnik mbH, Dusseldorf, Fed. Rep. of Germany

[21] Appl. No.: 477,883

[22] PCT Filed: Aug. 9, 1989

[86] PCT No.: PCT/DE89/00522

§ 371 Date: Apr. 23, 1990

§ 102(e) Date: Apr. 23, 1990

[87] PCT Pub. No.: WO90/01638

PCT Pub. Date: Feb. 22, 1990

[30] Foreign Application Priority Data

Aug. 12, 1988 [DE] Fed. Rep. of Germany ..... 3827405

[51] Int. Cl.[5] ..... F04B 43/12

[52] U.S. Cl. ..... 417/477; 417/9

[58] Field of Search ..... 417/9, 63, 474, 475, 417/476, 477; 604/153; 128/DIG. 12

[56] References Cited

U.S. PATENT DOCUMENTS 3,103,178 9/1963 Thompson ..... 417/477
3,105,447 10/1963 Ruppert ..... 417/475
4,110,061 8/1978 Gerritsen ..... 417/477
4,540,350 9/1985 Streicher ..... 417/475
4,576,553 3/1986 Winston et al. ..... 417/9

FOREIGN PATENT DOCUMENTS 0130374 1/1985 European Pat. Off. .

*Primary Examiner*—Leonard E. Smith
*Assistant Examiner*—Eugene L. Szczecina, Jr.
*Attorney, Agent, or Firm*—Toren, McGeady & Associates

[57] ABSTRACT

A hose pump has a housing (10) with a pressure connection (14) and an intake connection (12). A hose (22) is connected to the pressure connection and the intake connection and rests against the inner wall (24) of the housing (10). Squeezing members (26) can be moved along the hose (22) such that the hose is squeezed by each squeezing member from the direction of the intake connection (12) toward the direction of the pressure connection (14). The hose pump is characterized by at least one conduit (32) which is elastically deformable and whose one end (44) ends in the interior (46) of the housing (10) and whose other end (50) ends outside of the housing (10) and which is provided in the interior (46) of the housing such that by moving at least two additional squeezing members (26) which can be moved along the conduit, the conduit is squeezable from the direction of its one end (44) into the direction of its other end (50).

6 Claims, 1 Drawing Sheet

HOSE PUMP

TECHNICAL FIELD

The invention relates to a hose pump with a housing with a pressure connection and an intake connection, with a hose which is connected to the pressure connection and the intake connection and rests against the inner wall of the housing, and with at least two squeezing members which can be moved along the hose such that the hose is squeezable by each squeezing member from the direction of the intake connection toward the direction of the pressure connection.

BACKGROUND ART

Known hose pumps of this type differ essentially in the manner in which the hose is raised again in the intake area behind a squeezing member which is moved along the hose in order to squeeze the hose.

For example, hose pumps are known which have an elastic hose which has a relatively high natural restoring force. The restoring force desired in each case then depends on the desired suction height of the pump.

In another known type of hose pump, the restoring force for the hose is generated by a negative pressure in the pump interior. Several possibilities for generating and maintaining the necessary negative pressure in the interior of the hose pump are known from German patent 37 03 124. In accordance with a first embodiment, the necessary negative pressure at the suction side for restoring the squeezed hose is generated by a separating device which consists of a sealing part and a separating part, wherein the sealing part constitutes an elastic sealing member which is connected to the circumferential wall of the housing in the short region between the intake connection and the pressure connection and which sealingly rests in this region against the separating part, the front wall, the rear wall and the circumferential wall, while the separating part is constructed as a sealing member which is guided around the rotor with the squeezing members and acts sealingly relative to the front wall and the rear wall. A separating device of this type generates in the pump the negative pressure on the suction side of such a magnitude which corresponds to the suction height required at a given time. The same effect is achieved in accordance with another embodiment by filling all free spaces in the interior of the pump with a liquid. Thus, in the filled state, when the squeezing member is moved ahead on the hose by a certain distance and squeezes a new portion of the hose, the previously squeezed piece of hose cannot remain squeezed because this would create a hollow space in the liquid filled into the pump, which is impossible. Accordingly, the effect of the liquid creates a negative pressure which immediately raises each squeezed piece of hose as soon as the squeezing member moves ahead. As a result, the hose is raised by means of negative pressure. This makes it possible to achieve very high rates of rotation and, thus, a high delivery of the pump. The negative pressure generated when the squeezing member is moved ahead corresponds also in this embodiment exactly to the negative pressure in the hose on the suction side. Accordingly, the suction height is automatically adjusted also in this pump.

Compared to hose pumps having an elastic hose, hose pumps in which the hose is restored by a negative pressure are of more complicated construction which is understandable because of the necessary vacuum-tight construction. Thus, obtaining the negative pressure when mounting the separating device depends on the vacuum-tight connection of the components which move relative to each other in the housing. In the vacuum pump which is completely filled with liquid, there is the danger that when the vacuum is too great, the small amount of necessary lubrication liquid in the interior of the housing of the hose pump will foam, so that the restoring forces for raising the hose again cannot be generated or can only be generated to a reduced extent.

DISCLOSURE OF INVENTION

Starting from this known state of the art, the invention is based on the object to provide a hose pump of the above-mentioned type which is of simple construction and in which the restoring forces for raising the hose can be activated safely by negative pressure having the desired magnitude.

In the hose pump which was described above and is known from the prior art, this invention is characterized by at least a conduit which is elastically deformable and whose one end ends at the interior of the hose and whose other end ends outside of the housing, and which is provided in the interior of the housing in such a way that the movement of at least two second squeezing members which are movable along the conduit is capable of squeezing the conduit from the direction of its one end toward the direction of its other end. Thus, the invention starts from the finding that, when the hose pump is operated, squeezing the conduit—in the same manner as is being done with the conveying hose—air can be squeezed from the interior of the housing, so that a vacuum can be maintained or generated in the interior of the housing. This conduit may have a very small diameter. Accordingly, the hose provided for the actual conveying does not have to be elastically deformable, but can be raised again by the negative pressure, so that the advantages of a vacuum hose pump can be utilized.

The conduit which is used for maintaining or generating the vacuum in the interior of the hose pump can be arranged in the interior of the hose pump in such a way that the first squeezing members which serve for squeezing the conveying hose can also be used as the second squeezing members which are provided for generating or maintaining the vacuum. This results in a significant simplification of the structural principle of such a hose pump.

The hose pump according to the invention can only fully operate when the necessary atmospheric negative pressure has been built up in the interior. In order to keep the start-up time of such a hose pump as short as possible, the conduit is connected to the atmosphere surrounding the housing through a check valve which opens toward the atmosphere. When the hose pump is not operated, air cannot enter into the interior of the housing, so that the negative pressure existing at a given time is not lost, even if, when the hose pump stands still, squeezing members are not tightly resting against the conduit which may be desirable for at least a service life of the hose which is as long as possible. As a result, such a hose pump practically immediately generates its full power.

A further simplification is obtained when the conduit is placed within the wall of the hose. When the first hose is mounted, for example, during the first assembly or the replacement of the hose, the conduit is placed simultaneously. As a result, it is ensured that the conduit is always aligned in the correct position relative to the hose and, thus, to the squeezing members provided in the pump.

A simple type of manufacturing of the conduit is achieved when the conduit is formed by a hollow space in the wall of the first hose. This means that an actual hose wall for the conduit is unnecessary because the conduit merely may be a duct-like opening and, thus, a recess in the wall of the hose.

A very significant advantage results from providing the conduit or the duct-like opening in the hose closer towards the inner side than to the outer side of the first hose in the wall of the hose. Of course, the conduit must be arranged in the first hose with respect to the circumference in such a way that i&s cross-section is fully squeezed together when the hose is squeezed together. Therefore, the conduit is preferably provided in the bending region of the hose. Since, in addition, the conduit is positioned more closely to the inner side than to the outer side of the hose, the conduit is in that wall portion of the hose which is subjected to maximum stress during squeezing. Accordingly, when the hose is damaged which cannot be avoided after a more or less long operating time, the wall portion surrounding the conduit will rupture first toward the inside, so that the interior of the conduit is connected to the interior of the hose. This has the significant advantage that, when the hose pump is operated, the medium conveyed in the hose is discharged from the opening of the closed conduit. This is because during operation of the squeezing members, the medium conveyed in the hose is forced into the conduit and out of the conduit toward the outside. This can be determined by suitable monitoring devices and the hose pump can then be stopped immediately Thus, the conduit acts essentially as a monitor for the main hose because the conduit is the most endangered region of the first hose and, therefore, can immediately indicate that the main hose has partial cracks and should be replaced because, while it still provides the full power, it can be expected that the hose will completely rupture in a more or less short time and will be destroyed. Thus, when the hose pump is used for conveying foodstuffs, the pump can be stopped already before the main hose ruptures, so that the conveyed foodstuffs cannot be mixed with the lubrication liquid in the interior of the hose pump. This mean: that it is now possible to convey foodstuffs without problems by means of hose pumps.

BRIEF DESCRIPTION OF THE DRAWING

The invention is described and explained in more detail in the following with the aid of the embodiment shown in the drawings. In the drawing.

MODES FOR CARRYING OUT THE INVENTION

Figure 1:
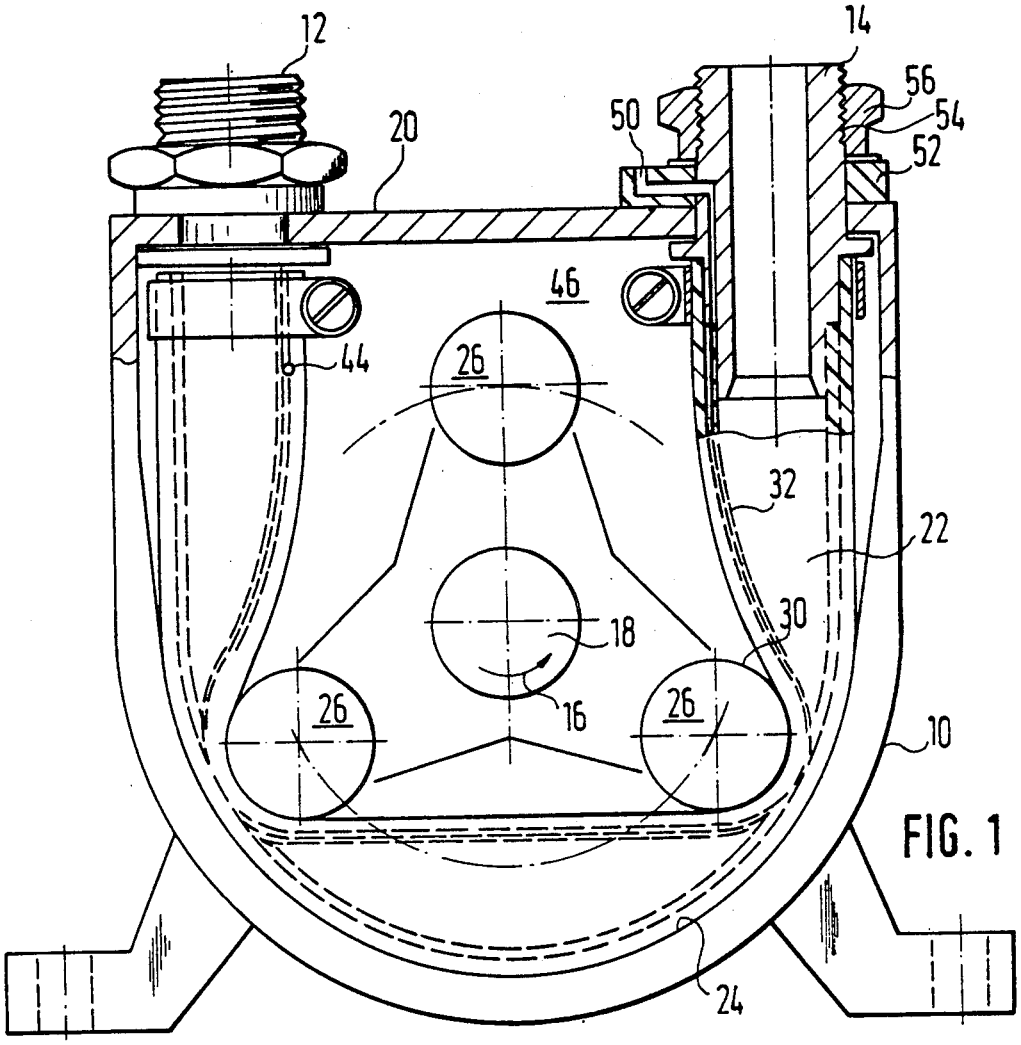
FIG. 1 is a cross-sectional view of a hose pump according to the invention.

A housing 10 of a hose pump has two connections of which the one shown on the left in the drawing is called an intake connection 12 and the connection on the right in the drawing is called a pressure connection 14. The direction 16 of rotation of a rotor 18 provided in the housing 10 is counterclockwise.

The two connections 12, 14 extend through the upper portion 20 of the housing 10 into the interior 46 of the housing 10 and are connected to each other through a hose 22.

This hose 22 rests in the lower, circular-cylindrical squeezing portion 24 of the housing 10 against the inner side of the housing 10 either directly or indirectly through a padding layer, not shown in the drawing The rotor 18 and the squeezing members 26 which are provided on the rotor 18 and rest squeezingly against the hose each form a cylindrical surface 30 toward the outside which rests sealingly against the end walls of the housing 10 which extend parallel to the plane of the drawing. To this extent, the above-described structural components correspond to the structural components of known hose pumps.

Figure 3:
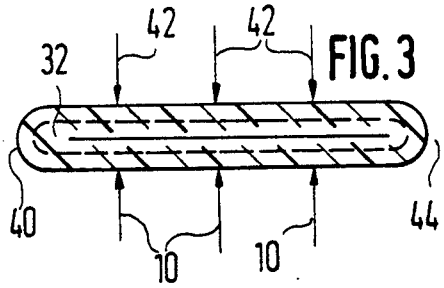
FIG. 3 shows the hose of FIG. 2 in the squeezed state.

The wall 31 of the hose 22 provided in the interior of the housing 10 has a duct-like opening 32 which serves as the second hose and extends parallel to the longitudinal axis 34 of the hose 22. The duct-like opening 32 is aligned more closely towards the inner side 36 than toward the outer side 38 of the wall 31. In addition, the opening 32 is arranged circumferentially in such a way that it is located, as shown in FIG. 3, in the left bending portion 40 of the hose 22 in which the introduction of force 42 of the squeezing members 26 deflects the hose in its cross-section by 180° and, thus, subjects the hose to maximum stress.

This duct-like opening 32 of the hose 22 has in the region of the intake connection 12 an opening 44 which opens into the interior 46 of the housing 10 in the upper region thereof. In the region of the pressure connection 14, the duct-like opening 32 has an air-tight connection with the outlet duct 50 which opens to the atmosphere with its other end outside of the housing 10 and extends through the sealing ring 52.

The pressure connection 14 has at its upper end an external thread 54 onto which is screwed u retaining nut 56 against the sealing ring 52 and against the upper portion 20 of the housing 10. The intake connection 12 is connected in a similar manner to the housing 10 and, thus, also to the hose 22. However, the intake connection 12 does not have the outlet opening 50 because at the intake connection 12 the duct-like opening 32 opens into the interior 46 of the housing 10 through the opening 44.

Figure 2:
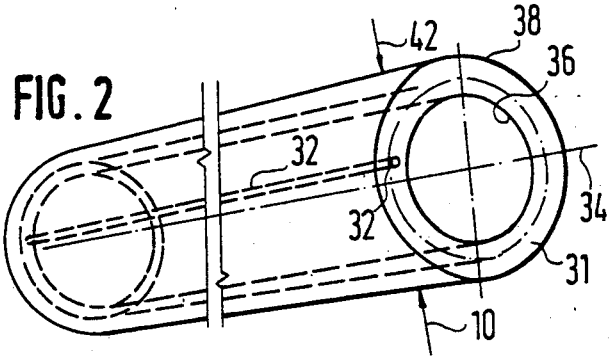
FIG. 2 is a perspective view of a portion of the hose used in the hose pump of FIG. 1

The hose pump according to FIGS. 1 to 3 operates as follows

When the rotor 18 rotates in the direction 16 of rotation, air is taken through the opening 44 from the interior 46 and is forced out of the outlet duct 50 into the atmosphere surrounding the housing 10. A check valve 60 which opens in the direction of the atmosphere is provided at the end of outlet duct 50. In the same manner as the squeezing members 26 fully compress the hose 22 ensuring their rotation in direction 16 at one location and, thus, completely close the cross-section at this location (FIG. 3), the duct-like opening 32 is also completely squeezed and, thus, closed by means of the squeezing member 26 at this location of the hose 22.

If the hose 22 should tear over time, such a tear will be formed at first on the inner side in the region of the bending areas 40, 41. Since the duct-like opening 32 is also provided in one of these areas, such a tear would open the duct 32 toward the inside, so that the duct-like opening 32 as such would no longer be effectively present. However, in this condition, the hose 22 would still be fully capable of operation; only the medium to be conveyed through the interior of the housing 2 would be discharged through the outlet opening 50 instead of air. When the hose pump is used for conveying foodstuffs, for example, for conveying soup, a portion of this soup would be discharged through the outlet duct 50. Thus, the hose pump could be stopped at a point in time at which the hose 22 itself is still intact and no intermingling has taken place between the lubricating liquid provided in the interior of the housing 10 and the product to be conveyer, for example, soup or the like. As a result, it would be possible to use such a hose pump without difficulties and legal problems for conveying foodstuffs.

I claim:

1. In a hose pump comprising a housing including a pressure connection and an intake connection;

a hose connected to the pressure connection and to the intake connection, the first hose resting against an inner wall of the housing;

at least two squeezing members, the squeezing members being movable along the hose such that the hose is squeezed by each squeezing member from a direction of the intake connection into a direction of the pressure connection;

at least one elastically deformable conduit, the conduit being mounted in the interior of the housing such that the conduit is squeezed by the movement of squeezing members from a direction of a first end of the conduit in a direction toward a second end of the conduit;

the improvement comprising the first end of the conduit being in communication with the interior of the housing, and the second end of the conduit being in communication with the atmosphere outside the housing.

2. The hose pump according to claim 1, wherein the conduit (32) is connected through a check valve to the atmosphere surrounding the housing, wherein the check valve opens in the direction to the atmosphere.

3. The hose pump according to claims 1, wherein the conduit (32) is aligned parallel to the hose (22) in the housing (10).

4. The hose pump according to claim 3, wherein the conduit (32) is provided within the wall of the hose (22).

5. The hose pump according to claim 4, wherein the conduit (32) is formed by a hollow space in the wall of the hose (22).

6. Hose pump according to claims 5, wherein the hollow space (32) is provided more closely toward an inner side (36) than to an outer side (38) of the hose (22).

* * * * *